United States Patent [19]

Moore

[11] 4,067,795

[45] Jan. 10, 1978

[54] PROCESS FOR COAL LIQUEFACTION USING ELECTRODEPOSITED CATALYST

[75] Inventor: Raymond H. Moore, Richland, Wash.

[73] Assignee: Battelle Memorial Institute, Columbus, Ohio

[21] Appl. No.: 695,988

[22] Filed: June 14, 1976

[51] Int. Cl.[2] ..... C10G 1/08

[52] U.S. Cl. ..... 208/10

[58] Field of Search ..... 208/10, 9

[56] References Cited

U.S. PATENT DOCUMENTS

| | | | |
|---|---|---|---|
| 1,299,565 | 4/1919 | Ellis | 204/10 |
| 1,919,108 | 7/1933 | Harrison et al. | 208/10 |
| 2,903,402 | 9/1959 | Fromm | 404/1.5 |
| 3,502,564 | 3/1970 | Hodgson | 208/10 |
| 3,532,617 | 10/1970 | Hodgson | 208/10 |
| 3,775,286 | 11/1973 | Mukherjee et al. | 208/10 |

*Primary Examiner*—Delbert E. Gantz
*Assistant Examiner*—James W. Hellwege
*Attorney, Agent, or Firm*—Klarquist, Sparkman, Campbell, Leigh, Hall & Whinston

[57] ABSTRACT

A process for the liquefaction of solid hydrocarbonaceous materials is disclosed. Particles of such materials are electroplated with a metal catalyst and are then suspended in a hydrocarbon oil and subjected to hydrogenolysis to liquefy the solid hydrocarbonaceous material. A liquid product oil is separated from residue solid material containing char and the catalyst metal. The catalyst is recovered from the solid material by electrolysis for reuse. A portion of the product oil can be employed as the hydrocarbon oil for suspending additional particles of catalyst coated solid carbonaceous material for hydrogenolysis.

10 Claims, 1 Drawing Figure

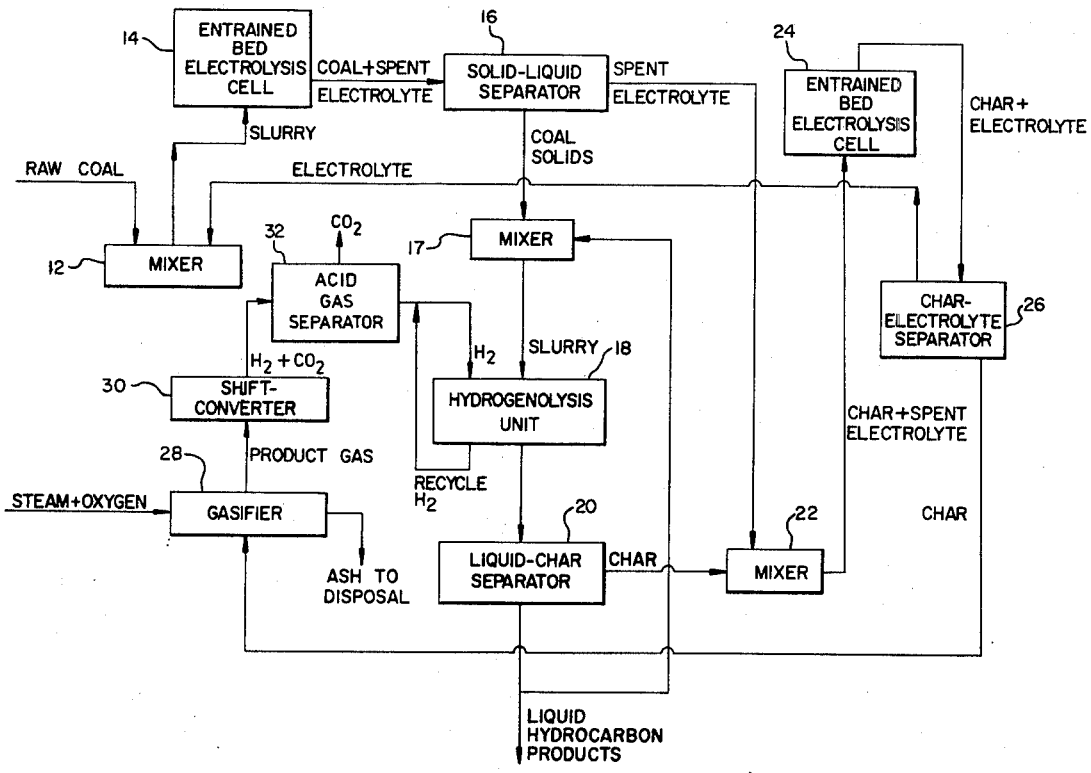

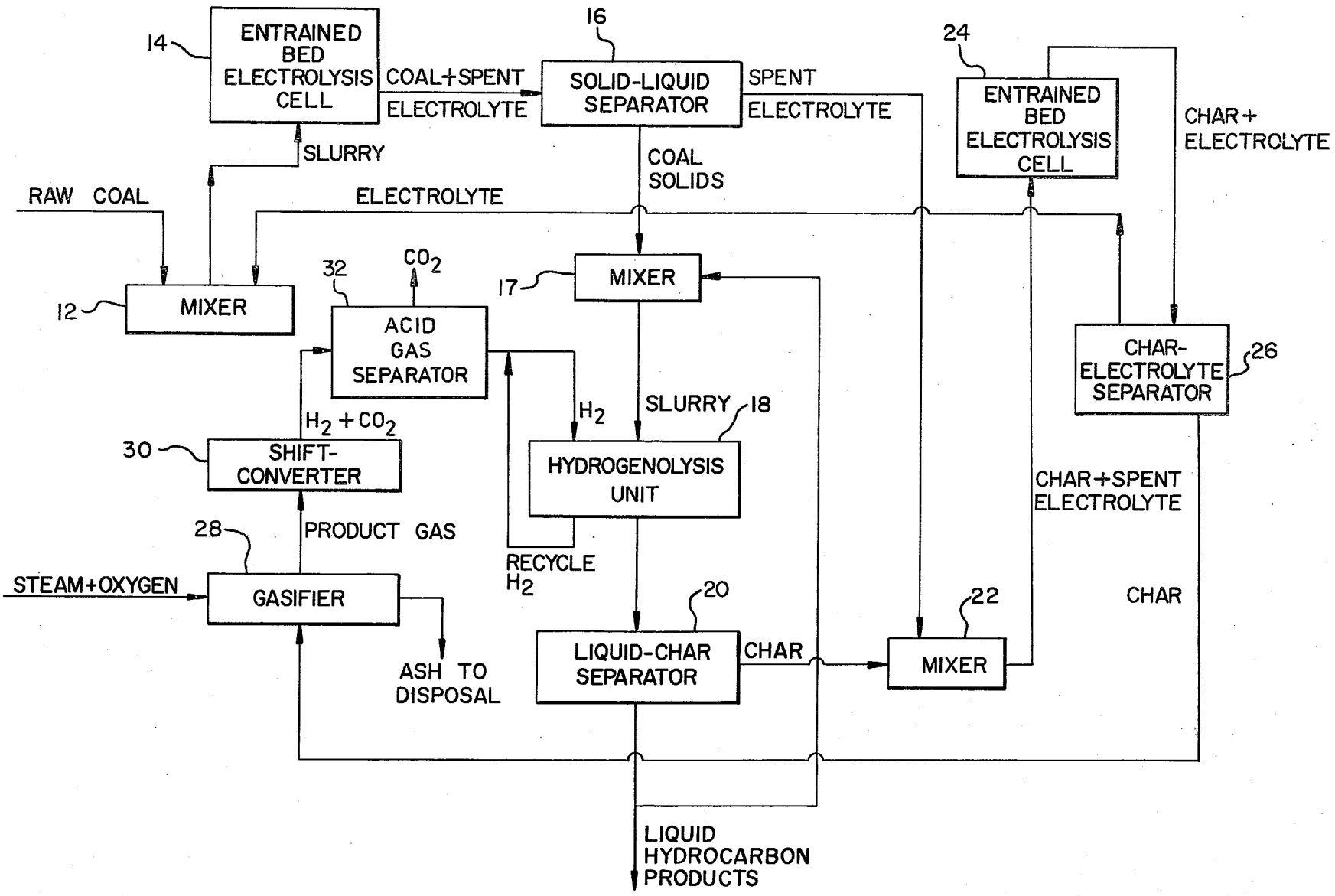
CHAR + ELECTROLYTE
26
CHAR-ELECTROLYTE SEPARATOR
CHAR + SPENT ELECTROLYTE
CHAR
ENTRAINED BED ELECTROLYSIS CELL
24
22
MIXER
SPENT ELECTROLYTE
CHAR
18
SLURRY
20
LIQUID HYDROCARBON PRODUCTS
16
SOLID-LIQUID SEPARATOR
COAL SOLIDS
MIXER
HYDROGENOLYSIS UNIT
LIQUID-CHAR SEPARATOR
$H_2$
RECYCLE $H_2$
17
COAL+SPENT ELECTROLYTE
ELECTROLYTE
$CO_2$
ACID GAS SEPARATOR
ASH TO DISPOSAL
32
$H_2 + CO_2$
SHIFT-CONVERTER
PRODUCT GAS
ENTRAINED BED ELECTROLYSIS CELL
SLURRY
MIXER
GASIFIER
14
30
28
12
RAW COAL
STEAM+OXYGEN

PROCESS FOR COAL LIQUEFACTION USING ELECTRODEPOSITED CATALYST

BACKGROUND OF THE INVENTION

This invention relates to a process for the liquefaction of solid carbonaceous materials by hydrogenolysis. More specifically it relates to the electro-deposition of metals onto coal particles, the use of the deposited metals as catalysts for hydrogenolysis of such coal and the recovery of the metal catalysts after hydrogenolysis.

Hydrogenolysis is a well known and widely practiced method of converting solid hydrocarbonaceous material such as coal into liquid fuels. Early in the development of this process it was discovered that process time could be reduced by conducting the hydrogenolysis at elevated temperatures and pressures. Later is was discovered and it is now widely known that the presence of certain metals or metal alloys increase the efficiency of the hydrogenolysis process even at mild reaction conditions.

In a typical hydrogenolysis step, the solid carbonaceous material is slurried in a heavy oil, which may be a recycled portion of the oil which is a product of the hydrogenolysis process. The slurry is retained in the pressure vessel and held at an elevated temperature and pressure while hydrogen gas is circulated through the slurry.

Although hydrogenolysis processes for the liquefaction of coal have undergone a great deal of study and improvement, hydrogenolysis has yet to be incorporated as a step in large scale coal liquefaction facilities because of the high operating costs and the large capital investment required. The present invention increases the efficiency and consequently the attractiveness of the hydrogenolysis process. This increased efficiency is attained by bringing the catalyst metal into closer contact with the coal product than has previously been possible, thereby maximizing the catalytic effect. The present invention further includes a method for an efficient recovery of the metal catalyst so that it may be continuously recycled in the system.

U.S Pat. No. 1,299,565 and more recently, U.S Pat. No. 3,703,446 describe the electroplating of metals onto particles of carbon. The electroplated graphite serves as a catalyst for hydrogenation processes such as the saturation of fatty oils. These patents do not deal with the problem of bringing metal catalysts into close contact with solid reactants. They show only the plating of purified carbon and are not concerned with electroplating catalyst metal directly upon naturally occurring hydrocarbonaceous materials, the very material which is hydrogenolyzed in the process. The plated carbon in these references was itself inert and served only as a carrier for the catalyst metals.

Electrolytic recovery of metals from metal ores and especially from graphite bodies has appeared in a variety of forms in the prior art.

SUMMARY OF THE INVENTION

It has now been discovered that metal electrolytically deposited onto coal particles will directly catalyze the reaction of hydrogen with coal under hydrogenolysis conditions. It has further been discovered that due to the intimate contact of the metal catalysts, coal particles and hydrogen gas that a hydrogenolysis of coal is accomplished with greater efficiency than has previously been observed. A savings in processing costs results because at given hydrogenolysis conditions slurried coal particles upon which a catalyst metal has been deposited, will react with hydrogen more completely than slurried coal which is brought in contact with a catalyst bed. After the hydrogenolysis process is complete, the liquid hydrocarbon products are easily separated from the solid char residue and solid metal catalyst. The catalyst remains in intimate contact with the char, but may be recovered in a second electrolytic process. In the catalyst recovery step, metal plated on the char is re-dissolved in an electrolyte solution. Next, the solid char is mechanically separated from the liquid electrolyte solution. This solution with the dissolved metal catalyst is recycled to the first electrolysis cell and used to plate the catalyst metal on additional amounts of raw coal.

An object of the present invention is to provide a method for bringing a coal hydrogenolysis catalyst into intimate contact with coal particles to be hydrogenolyzed.

A further object is to provide a process whereby the catalyst metal may be continuously recycled.

BRIEF DESCRIPTION OF THE DRAWING

The drawing which accompanies this disclosure is a schematic flow diagram which illustrates the various steps of the present invention and which includes steps for recycling of the catalyst metal.

DESCRIPTION OF THE PREFERRED EMBODIMENT

The process of the present invention may be most fully appreciated by referring to the accompanying diagram.

The solid hydrocarbonaceous material which may be hydrogenolyzed by the process of the present invention includes coal, lignite, oil shale, tar sand and similar naturally occurring hydrocarbonaceous material. The present invention is particularly applicable to the conversion of a bituminous coal. Although the following process description refers only to the preferred bituminous coal, the discussion is equally applicable to the other solid hydrocarbonaceous materials noted above unless otherwise stated.

In a mixer 12, raw coal particles are combined with an aqueous electrolyte solution which contains dissolved metal catalysts, the dissolved metal being present as an ion of a soluble compound of the metal. The size of the coal particles entering the mixer is not especially critical, however, it is desirable that the particles be uniform in size. A convenient size is −30 mesh (Tyler Standard screen). The metal catalyst dissolved in the electrolyte solution may include any of the recognized hydrogenolysis metal catalysts. Catalytic metals which have been successfully electrodeposited include Ag, Pb, Cd, Cu, Pt, Pd, Au, Bi, Fe, Ni, Co, Cr, Mo, W, Sn, Sb, etc. In addition, alloys or mixtures of two or more catalytic metals may be used.

Coal, mixed with the electrolyte solution, forms a slurry which is pumped through the cathode section of an entrained bed electrolysis cell 14. The cathode section is a suspension cathode wherein multiple impacts of coal particles impinging on an exciting cathode grid causes the particles to acquire negative charges so that the particles in turn behave as cathodes. Uncharged coal particles which come into contact with the charged coal particles acquire a portion of the negative charge. Positively charged catalyst metal ions in solution which encounter the negatively charged coal particles discharge and deposit on the particles.

The cathode grid is preferably comprised of a metal, such as platinum, which exhibits a low hydrogen overvoltage. Hydrogen gas produced at the surface of such a cathode tends to prevent the deposition of the catalyst ions on the cathode. The catalyst ions thus preferentially deposit on the charged coal particles.

The entrained bed electrolysis cell 14 may be of any suitable design incorporating a suspension cathode wherein the coal-electrolyte slurry is physically separated from the anode chamber by an ion permeable membrane which will prevent the flow of coal particles. U.S. Pat. No. 3,703,446 illustrates an electrolytic cell used for plating metal onto graphite. A cell of somewhat similar design could be used to electroplate coal. In this type of cell, coal particles form a bed in the bottom of the cathode chamber. The electrolyte solution containing metal catalyst ions is passed up through the bottom of the cathode chamber fluidizing the bed of coal particles and maintaining a plentiful supply of catalyst ions at the coal particle surfaces. If this type of cell is employed, the separate mixer 12 is not essential to prepare the coal-electrolyte slurry.

Reaction products leaving the entrained bed electrolysis cell 14 include coal particles plated with the metal catalyst and spent electrolyte solution which is partially depleted of metal catalyst ions. The combined reaction products are sent to a solid-liquid separator 16 where the spent electrolyte solution is separated from the plated coal particles by any suitable means. The plated coal particles are transferred to a mixer 17 where they are mixed with a hydrocarbon oil to form a slurry. This slurry is delivered to a hydrogenolysis unit 18. In this unit coal particles plated with metal catalysts are contacted with a stream of hydrogen gas at elevated temperatures and pressures. The hydrogenolysis unit 18 may be any suitable design known in the art. Due, however, to the intimate contact of the catalyst metal with the coal particles, a given hydrogenolysis unit will achieve the same degree of liquefaction in a shorter length of time than would the same unit processing unplated coal.

One suitable design for a hydrogenolysis unit is a fluidized bed reactor wherein plated coal particles form the bed which is fluidized by hydrogenolysis gases entering beneath the bed. Hydrogen gas not consumed during hydrogenolysis may be collected and recycled through the hydrogenolysis unit 18.

The product of hydrogenolysis include a liquid hydrocarbon product and a residue of char solids which includes the metal catalysts. The combined reaction products are sent to a liquid-solid separator 20 where the char and catalyst are separated from liquid hydrocarbon products. Any suitable separator may be used to accomplish this step.

To recover the catalyst, unreacted char particles containing the catalyst solids are combined with the spent electrolyte solution from the solid-liquid separator 16 in a mixer 22 to form a char-electrolyte slurry. This slurry from the mixer 22 is sent to a second entrained bed electrolysis cell 24 which has a polarity the opposite of the entrained bed electrolysis cell 14 and pumped through the anode chamber of the electrolysis cell 24. Impact of the char-catalyst particles impinging on the anode cause the metal atoms to give up electrons and thus reacquire a positive charge. The positively charged metal ions dissolve in the electrolyte solution leaving char particles as the only undissolved solids.

The slurry which leaves the entrained bed electrolysis cell 24 thus contains char solids and catalyst metal ions dissolved in the electrolyte solution. This slurry moves to the char-electrolyte separator 26 where the solid char particles are separated from the liquid electrolyte solution. The electrolyte solution which now has a renewed catalyst ion concentration is transferred to a suitable storage area, not shown, and held for mixing with the raw coal particles in the mixer 12 as previously described. The char from the char-electrolyte separator 26 is sent to a gasifier 28. In the gasifier 28 the char is combined with steam and air at elevated temperatures to produce carbon monoxide and hydrogen gas. The amount of char which is available for gasification is largely determined by the conditions in the hydrogenolysis unit 18. Preferably these conditions are adjusted to leave a sufficient amount of char for production of the entire hydrogen requirement of the hydrogenolysis unit 18. Solid ash which remains after gasification is discharged from the process. The gaseous products of the gasifier 28 are sent to a shift converter 30. In the shift converter 30, carbon monoxide in the product gas is converted into $CO_2$. The mixture of gases leaving the shift converter is transported to an amine type acid gas separator 32 wherein hydrogen is separated from the carbon dioxide. The hydrogen is recycled for use in the hydrogenolysis unit 18.

The electro deposition of metals onto coal was originally studied in the context of a method for the purification of $ZnSO_4$ electrolyte solution. In these experiments, $ZnSO_4$ electrolytes containing some copper ions were introduced into a cell containing coal particles. Despite the fact that conditions were not optimized for the deposition of copper, a significant amount of copper was plated onto the coal particles when a potential was applied across the cell electrodes. A current efficiency of twenty-five percent was established in electrodepositing copper onto coal particles from an electrolyte solution containing 200 g/l $ZnSO_4$ and 1.0 g/l $Cu^{+2}$. Current efficiency increased to eighty-four percent with a similar solution containing 25.4 g/l $Cu^{+2}$.

The apparatus used for this experimental determination consisted of 1500 ml pyrex beaker, a copper cathode in the configuration of a grid located at the bottom of the beaker and a 1.5 inch by 2 inch platinum sheet anode. A settled bed comprising 170 grams of coal particles covered the cathode to a depth of about 3 inches; and the beaker was filled with a supernatant electrolyte solution. The anode was immersed in the electrolyte solution 1.0 to 1.5 inches above the top of the coal bed. Power was supplied to the electrodes from a selenium rectifier. With the dilute (1.0 g/l $Cu^{+2}$) solution, 19.86 grams of copper were deposited in 3.5 hours at 4.0 amperes and a voltage of from 5.0 to 10.8 volts. In the case of a concentrated solution (25.4 g/l $Cu^{+2}$), 90.6% of the available copper was deposited.

Deposits of copper stood out in contrast to the black surface of the coal particles. In the first few minutes, about 10 percent of the carbon particles showed visible patches of bright copper. After an hour or so, nearly all the particles exhibited such deposits. As the deposition continued, the coal particles remained free flowing and had not cemented together with conducting copper bridges even at 21 weight percent copper on the suspension electrode of coal particles.

Assuming an electrolytic cell with a unit cell volume of one cubic meter, a current of 4000 amperes/$m^3$ at an applied potential of 4 to 5 volts, and a current efficiency of one hundred percent, it is possible to calculate the rate at which a monolayer of nickel is deposited on coal particles of a certain size. For the purpose of calculation it is assumed that the coal particles are uniformly spherical, of 0.5 mm diameter (−30 mesh), and that the exterior surface of the coal is all that is involved. Once the mass of nickel to produce a monolayer in a ton of coal is known, then from the electrochemical equivalent for nickel (2,413 lbs. Ni/1000 ampere hours) the required coal flow rate is obtained.

Table I shows a coal flow rate calculated for the conditions presumed above and the parameters needed to calculate that flow rate.

Table I

| Parameter | Result |
|---|---|
| Coal particle surface area | $7.85 \times 10^{-3}$ $cm^2$/particle |
| Coal particle volume | $6.54 \times 10^{-5}$ $cm^3$/particle |
| No. particles/$cm^3$ | $7.95 \times 10^3$ |
| Mass of particles/$cm^3$ | 1.0 g |
| Area of particles/$cm^3$ | 62.4 $cm^2$ |
| Ni metal atom radius | $1.26 \times 10^{-8}$ cm |
| Area screened by Ni atom (assumed circular) | $4.75 \times 10^{-17}$ $cm^2$ |
| Ni atoms in monolayer | $1.31 \times 10^{18}$/$cm^3$ |
| Mass of Ni in monolayer | $1.28 \times 10^{-4}$g Ni/$cm^3$ |
| Mass Ni/ton coal | 0.26 lb/ton coal |
| Coal flow rate | 37 tons/hr/$M^3$ |

EXAMPLE I

This example utilizes a system similar to the one illustrated in the accompanying flow diagram. In this system the metal catalyst is nickel, the electrolyte solution consists of 50 to 100 g/l $NiSO_4$. Anodes and the exciting cathode grid are pure nickel (cathode grade). Electrolyte pH is adjusted to the range 4.5 to 6.0. The slurry formed in the mixer 12 is about 50 percent solids. The entrained bed electrolysis cell 14 is a 1 cubic meter cell and the electrolysis conditions are those of the 1 cubic meter cell described above.

The hydrogenolysis unit 18, operating at 2700 psi and 850° F., can be assumed to produce a conversion yield of at least 75 percent. The gasifier 28 operates at a reaction temperature of 900° C.

Under the above conditions the flow rate for the various system streams, as they appear in the attached flow diagram, will be approximately as follows:

Table II

| Description | Flow | |
|---|---|---|
| Raw coal (−30 mesh) | 37 | tons/hr |
| Electrolyte | 37 | tons/hr |
| Slurry | 74 | tons/hr |
| Coal solids | 37 | tons/hr |
| Spent electrolyte | 37 | tons/hr |
| $H_2$ * | 6.7 | tons/hr |
| Char | 9.25 | tons/hr |
| Char + Spent electrolyte | 46.25 | tons/hr |
| Steam (60%) + Oxygen (40%) | 14.5 | tons/hr |
| Product gas (75%CO, 25%$H_2$) | 22.0 | tons/hr |

* Total $H_2$ flow into the hydrogenolysis unit will run close to 444,000 SCF/hr (37 tons/hr). Therefore, there will be a substantial recycle $H_2$ stream.

EXAMPLE II

A high volatile bituminous coal was used as a suspension cathode in a cell having a platinum cathode grid. An aqueous electrolyte containing 20 g/l $NiSO_4 \cdot 6H_2O$ and sufficient $NH_4OH$ to make the electrolyte ammoniacal was introduced into a cell. After 4 hours of electrolysis, at 1.0 ampere, nickel plated coal was removed from the cell. This coal product was 3.99 weight percent nickel. Patches of nickel metal were visible on the coal particles under low power magnification.

Two hydrogenolysis runs were then conducted. In the first run 30 grams of catalyst plated coal (25.3 grams maf coal) were suspended in 200 ml of decalin, placed in a 1 liter rocking autoclave and pressurized to 300 psig with $H_2$. The autoclave was heated to 400° C. and rocked 4.25 hours and then cooled. In the second run, 15 grams of "Harshaw Ni-4301," a commercial sulfided Ni-W catalyst, having 6 weight percent nickel and 10 weight percent tungsten supported on silica-alumina, was added to 25.3 grams of untreated coal and then autoclaved at conditions identical to the first run. Results of the two runs are summarized in Table III.

Table III

| Run No. | Coal, maf (grams) | Final pressure (psig) | Percent yield (decalin soluble) | Percent yield (benzene soluble) | $H_2$ consumed (moles/gram of coal) |
|---|---|---|---|---|---|
| 1 | 25.3 | 790 | 60 | 72 | 194 |
| 2 | 25.3 | 690 | 72 | 74.5 | 180 |

While I have shown and described a preferred embodiment of my invention, it will be apparent to those skilled in the art that many changes or modifications may be made without departing from my invention in its broader aspects.

I claim:

1. A process for converting solid hydrocarbonaceous material into liquid hydrocarbon products which comprises:

electrodepositing on a solid hydrocarbonaceous material a catalyst metal capable of promoting hydrogenolysis; and contacting the catalyst coated material with hydrogen at an elevated temperature and pressure to produce said liquid products and a char containing the catalyst metal.

2. A process according to claim 1 wherein the solid hydrocarbonaceous material is coal.

3. A process according to claim 1 wherein said electrodepositing comprises:

slurrying said material in an electrolyte solution containing dissolved ions of said catalyst metal;

pumping the resulting slurry through a cathode chamber of an entrained bed electrolysis cell to cause said catalyst metal to be plated on said material; and separating the material plated with said catalyst metal from the spent electrolyte solution which remains after the electrodepositing.

4. A process according to claim 1 wherein the catalyst metal comprises at least one metal chosen from the group consisting of Ag, Pb, Cd, Pt, Pd, Au, Bi, Fe, Ni, Co, Cr, Mo, W, Sn, and Sb.

5. A process according to claim 1 further comprising mixing said catalyst coated material with a liquid hydrocarbon oil to form a slurry prior to said contacting.

6. A process according to claim 1 which further comprises:

separating the char from the catalyst metal; and recycling the catalyst metal for deposition onto additional solid hydrocarbonaceous material.

7. A process according to claim 6 wherein said separating comprises:

mechanically separating said liquid products from the char and catalyst metal;

combining the char and catalyst metal with a spent electrolyte solution which remains after said electrodepositing to form a char-electrolyte slurry;

pumping said char-electrolyte slurry through an anode chamber of an entrained bed electrolysis cell wherein the catalyst metal is ionized and dissolves in the electrolyte solution; and mechanically removing the char from the electrolyte solution and dissolved catalyst metal.

8. A process according to claim 7 which further comprises:

gasifying the removed char to produce hydrogen and other gases; and using said hydrogen in said hydrogenolyzing step.

9. A process for converting coal particles into liquid hydrocarbon products which comprises:

slurrying coal particles in an electrolyte solution containing dissolved ions of a catalyst metal capable of promoting hydrogenolysis;

pumping the resulting slurry through a cathode chamber of an electrolysis cell to cause said catalyst metal to be plated onto said particles;

separating the catalyst coated particles from the spent electrolyte solution which remains after the particles are coated; and contacting the catalyst coated particles with hydrogen at an elevated temperature and pressure to produce said liquid products and a char containing the catalyst metal.

10. A process according to claim 9 which further comprises:

mixing said catalyst coated particles with a liquid hydrocarbon oil to form a slurry prior to said contacting;

mechanically separating said liquid products from the char and catalyst metal;

slurrying the char and catalyst metal with said spent electrolyte solution;

pumping the resultant char-electrolyte slurry through an anode chamber of an entrained bed electrolysis cell wherein the catalyst metal is ionized and dissolves in the electrolyte solution;

mechanically removing the char from the electrolyte solution and dissolved catalyst metal;

using said electrolyte solution and dissolved catalyst metal in said slurrying of said particles;

gasifying the removed char to produce hydrogen and other gases; and using said hydrogen in said contacting step.

* * * * *